US005182872A

United States Patent [19]

Lee et al.

[11] Patent Number: 5,182,872

[45] Date of Patent: Feb. 2, 1993

[54] SOUND PRODUCING CONTROL SWITCH FOR A PICTURE-FRAME

[76] Inventors: Larry Lee, Taipei Hsien; Jack Kao, Nan Tou City, both of Taiwan

[21] Appl. No.: 774,324

[22] Filed: Oct. 10, 1991

[51] Int. Cl.[5] ..... G09F 1/12; G09F 27/00; A63H 33/38; A63H 5/00

[52] U.S. Cl. ..... 40/152; 40/455; 40/906; 446/147; 446/397; 446/484

[58] Field of Search ..... 446/147, 175, 397, 404, 446/408, 484, 489; 40/455, 152, 155, 124, 906

[56] References Cited

U.S. PATENT DOCUMENTS

| | | | |
|---|---|---|---|
| 4,072,314 | 2/1978 | Rosen et al. | 40/455 X |
| 4,299,041 | 11/1981 | Wilson | 40/906 X |
| 4,531,310 | 7/1985 | Acson et al. | 40/455 X |
| 4,541,188 | 9/1985 | Sadorus | 40/455 X |
| 4,696,653 | 9/1987 | McKeefery | 446/175 |
| 4,703,573 | 11/1987 | Montgomery et al. | 40/455 |
| 4,748,756 | 6/1988 | Ross | 40/455 X |
| 4,791,741 | 12/1988 | Kondo | 40/455 X |
| 4,836,075 | 6/1989 | Armstrong | 446/397 X |

FOREIGN PATENT DOCUMENTS

| | | | |
|---|---|---|---|
| 2613863 | 10/1988 | France | 40/906 |
| 1540822 | 2/1979 | United Kingdom | 40/906 |

*Primary Examiner*—D. Neal Muir
*Attorney, Agent, or Firm*—Bacon & Thomas

[57] ABSTRACT

A sound producing control switch for a picture-frame, includes a control circuit which is fastened in the back cover of a picture-frame. The control circuit includes a music IC, a battery power supply and a speaker, a conductive strip fastened in the picture-frame at the inside, two leaf springs mounted on the window glass of the picture-frame, which leaf springs are respectively connected to the two opposite terminals of the control circuit and constantly forced to contact the conductive strip by two spring means. The control circuit is triggered to produce the sound of "I Love You" twice when the picture-frame is touched to produce a short circuit signal. The spring means automatically force the leaf springs to contact the conductive strip immediately after the leaf springs have been forced to disconnect from the conductive strip.

1 Claim, 4 Drawing Sheets

SOUND PRODUCING CONTROL SWITCH FOR A PICTURE-FRAME

BACKGROUND AND SUMMARY OF THE INVENTION

The present invention relates to picture-frames and relates more particularly to a picture-frame with a sound producing switch which is triggered to produce a sound through a speaker when the picture-frame is touched or moved.

Various types of picture-frames made from any of a variety of materials have been disclosed for showing pictures. According to conventional manufacturing methods, a picture-frame provides only a static sense of beauty. The present invention is to endow a picture-frame with an active life. By fastening some triggering elements and a sound producing mechanism in a picture-frame, a picture-frame is enabled to make a speech or produce music once it is touched by external force.

DETAILED DESCRIPTION OF THE PREFERRED EMBODIMENT

Figure 1:
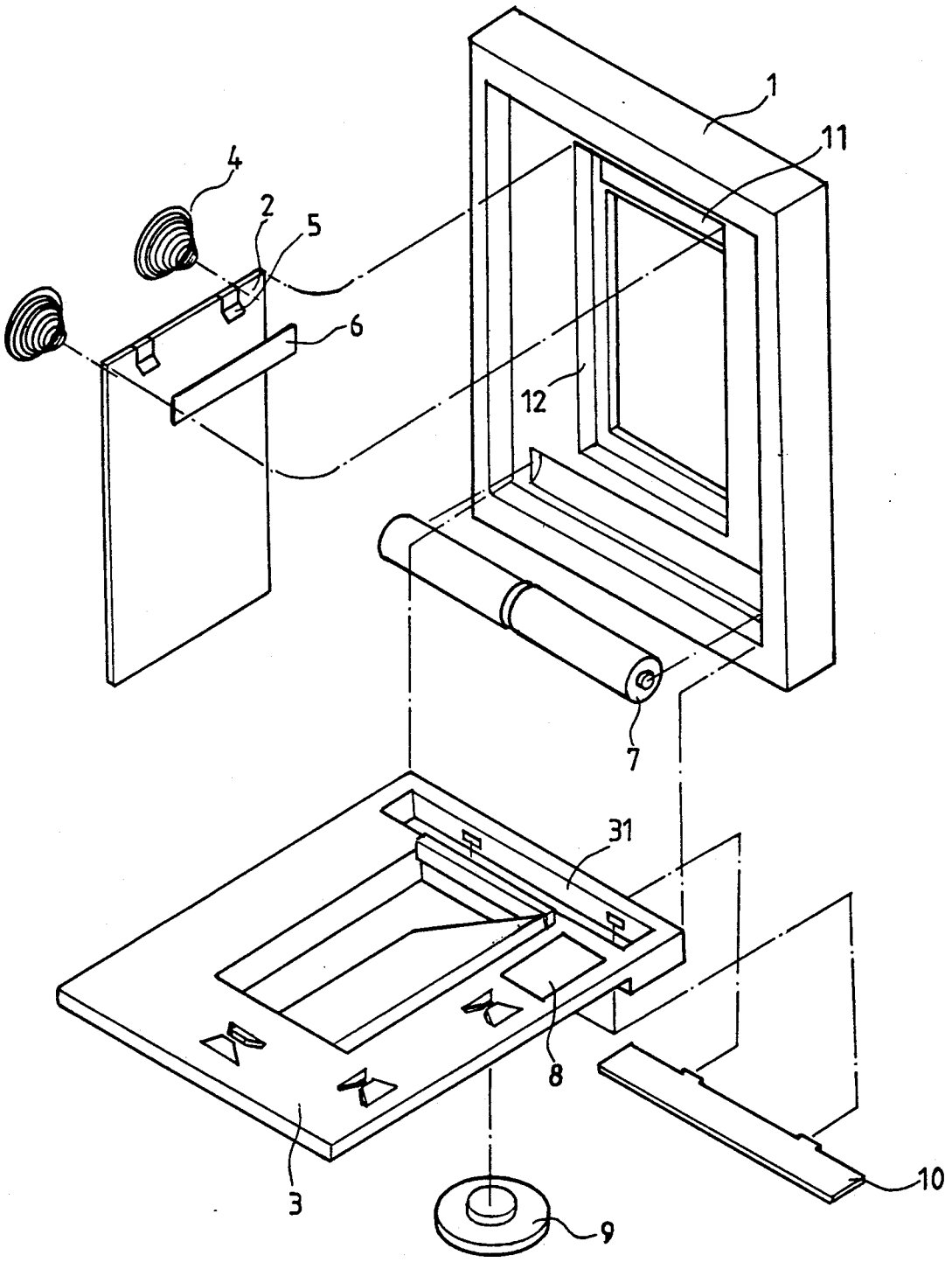
FIG. 1 is an exploded perspective view of the preferred embodiment of the sound producing control switch for a picture-frame of the present invention.
Figure 2:
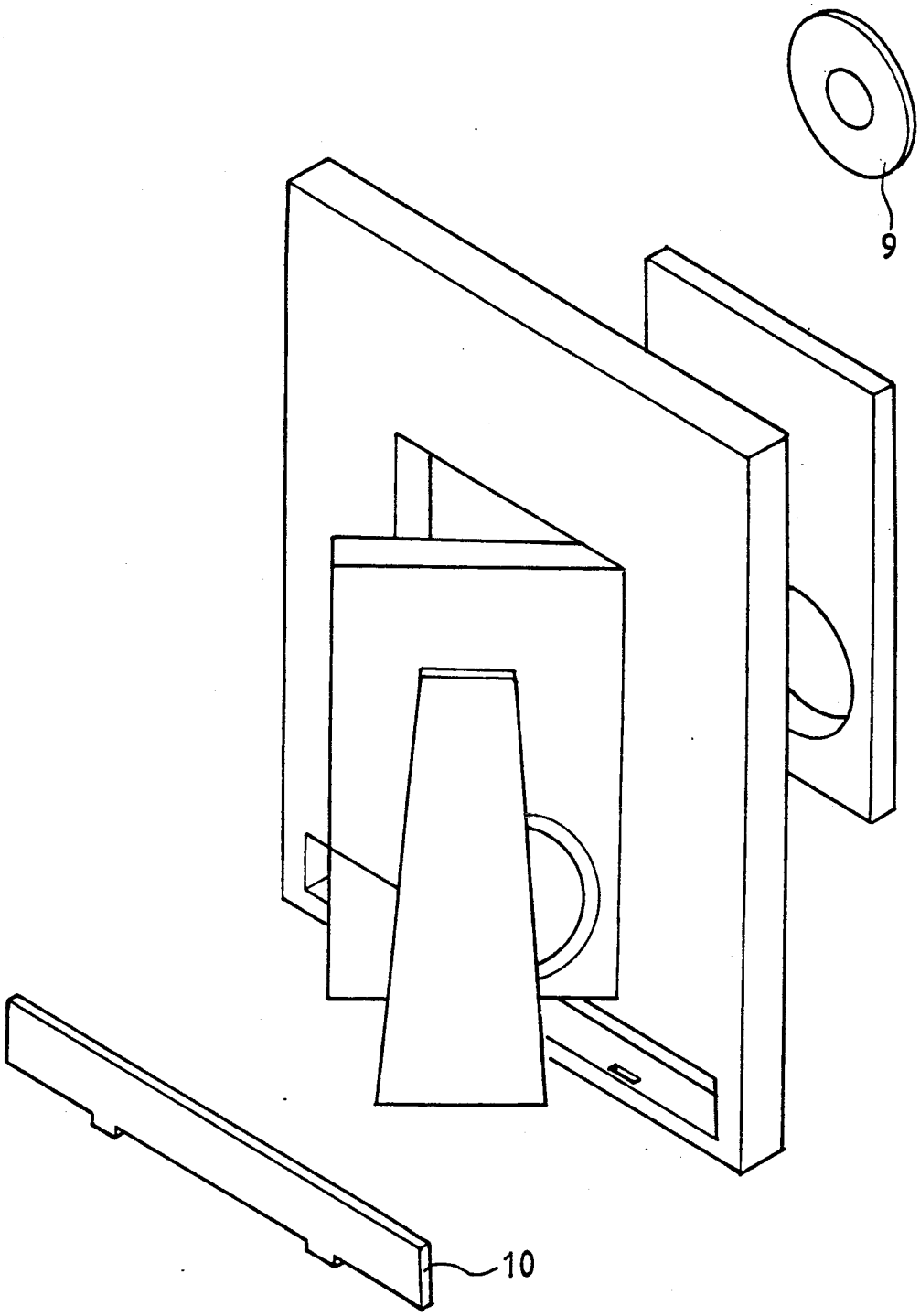
FIG. 2 is a dismantled perspective view of the back cover thereof.
Figure 3:
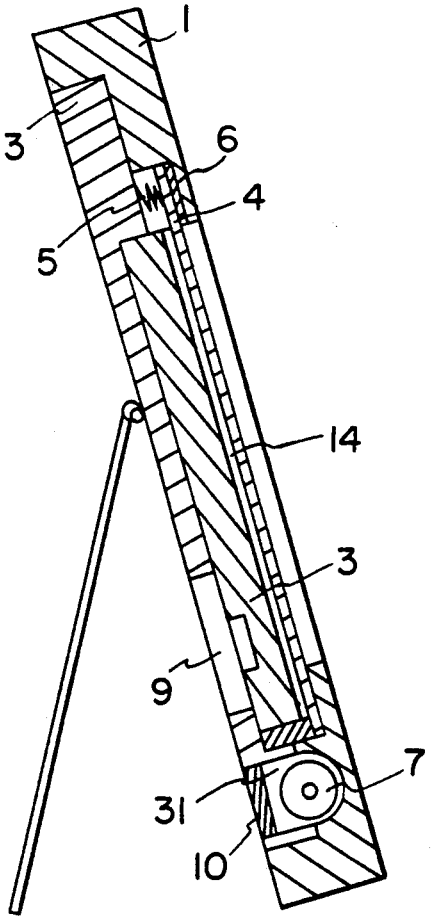
FIG. 3 is a side view thereof.
Figure 4:
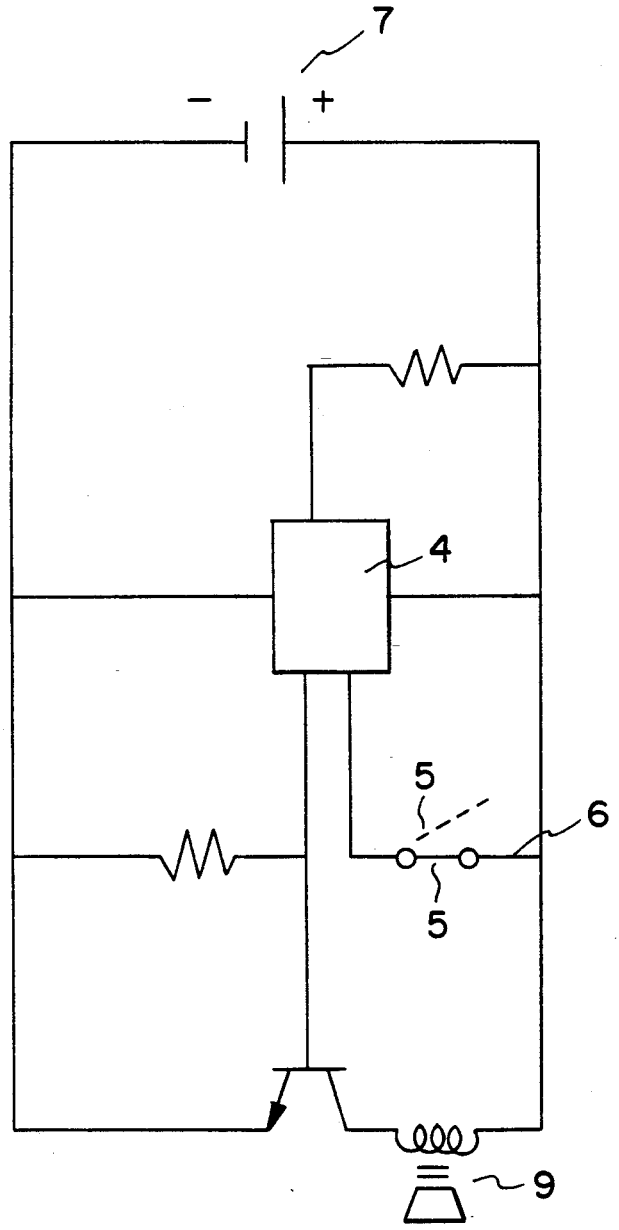
FIG. 4 is the circuit diagram thereof.

Referring to FIG. 1, the preferred embodiment of the sound producing control switch for a picture-frame as constructed in accordance with the present invention is generally comprised of a base frame 1, a sheet of glass 2, a back cover 3, two spiral springs 4, two leaf springs 5, a conductive strip 6, a battery set 7, a PC board 8, a speaker 9 and a battery lid 10. The conductive strip 6 is made from a thin, flat copper strip adhered to the base frame 1 at an upper position inside the recess 12 therein. The leaf springs 5 are clamped on the sheet of glass 2 at the top corresponding to the conductive strip 6 and respectively connected to the two positive and negative terminals of the PC board 8 by electric wires. The spiral springs 4 are respectively welded to the leaf springs 5 for return control. Once the leaf springs 5 are disconnected from the conductive strip 6, the spiral springs 4 will automatically force the leaf springs 5 to contact the conductive strip 6 again. The battery set 7 which provides the PC board 8 and the speaker 9 with the necessary working voltage is set in a battery chamber 31 on the back cover 3 at one end and covered by the battery lid 10.

After assembly, the sheet of glass 2 is closely attached to the inside bottom edge in the recess 12 of the base frame 1 permitting the leaf springs 5 to be disposed in contact with the conductive strip 6 therein. The contact signal of the leaf springs 5 with the conductive strip 6 is transmitted to the PC board 8 causing it to turn off the speaker 9. Therefore, the speaker 9 does not work under normal conditions. Once the picture-frame is picked up or shaken by an external force, the leaf springs 5 will temporarily disconnect from the conductive strip 6 causing an open circuit whenever the glass 2 is caused to move in the normal clearance 14 between glass 2 and back cover 3. The open circuit causes the PC board 8 causing it to produce the sound of "I Love You" twice. This action will occur again only when the switch (between the leaf springs 5 and the conductive strip 6) is triggered again. The PC board 8 is triggered to produce a sound through the speaker 9 once the input signal thereto is changed from Hi to Lo. This operational program is burnt in an IC in the PC board 8 which is not changeable. The type and nature of the sound to be produced by the PC board 8 through the speaker 9 can be variously designed before the assembly process of the present invention.

What is claimed is:

1. A sound producing control switch for a picture-frame having a back and a front, comprising:

a picture-frame body having defined therein a show window, said show window having a back and a front;

a conductive strip made from a thin, flat copper strip adhered to the back of said show window at an upper position;

a sheet of glass covering said show window;

two leaf springs clamped on said sheet of glass and disposed in contact with said conductive strip;

a back cover covering the back of said picture-frame body;

two springs means respectively secured to said two leaf springs and positioned against said back cover;

a control circuit fastened in said back cover, the control circuit including two opposite terminals electrically connected to said two leaf springs, a battery power supply, a music IC and a speaker;

wherein said conductive strip, show window, and leaf springs are arranged such that movement of said picture-frame body causes said two leaf springs to temporarily disconnect from said conductive strip, triggering said control circuit to produce a sound through said speaker, and wherein said spring means is arranged to automatically force said two leaf springs to contact said conductive strip immediately after said two leaf springs have been caused to disconnect from said conductive strip to prevent said sound from repeating.

* * * * *